United States Patent [19]

Yoshida

[11] Patent Number: 4,932,092

[45] Date of Patent: Jun. 12, 1990

[54] PROCESS AND APPARATUS FOR CONTINUOUS DYEING OF ELONGATE TEXTILE MATERIAL

[75] Inventor: Hiroshi Yoshida, Kurobe, Japan

[73] Assignee: Yoshida Kogyo K. K., Tokyo, Japan

[21] Appl. No.: 401,821

[22] Filed: Sep. 1, 1989

[30] Foreign Application Priority Data

Sep. 6, 1988 [JP] Japan ..... 63-224125

[51] Int. Cl.[5] ..... D06B 1/14; D06B 11/00; D06B 21/00

[52] U.S. Cl. ..... 8/149; 8/151; 68/9; 68/13 R; 68/19; 68/203

[58] Field of Search ..... 8/149, 151; 68/9, 13 R, 68/19, 20, 175, 202, 203

[56] References Cited

U.S. PATENT DOCUMENTS 4,015,453 4/1977 Bryant ..... 68/202
4,571,962 2/1986 Sando et al. ..... 68/175 X
4,748,706 6/1988 Dorrity et al. ..... 68/13 R X
4,771,497 9/1988 Fleissner ..... 68/13 R X
4,845,964 7/1989 Bors et al. ..... 68/202 X

FOREIGN PATENT DOCUMENTS 0185855 9/1985 Japan ..... 68/175

*Primary Examiner*—Philip R. Coe
*Attorney, Agent, or Firm*—Hill, Van Santen Steadman & Simpson

[57] ABSTRACT

A process and apparatus is disclosed for dyeing an elongate textile material with different colors at predetermined intervals in a substantially continuous, uninterrupted cycle of operation. The apparatus comprises a plurality of dye baths exchangeable one with another, a nip and guide roll assembly rotatable into dyeing position in timed relation to the particular dye bath which has been exchanged; an orienting guide roll assembly carrying thereon a plurality of guide rolls and a cam plate adapted to retract one of the guide rolls away from the path of dyed material, and a cylindrical drum drier having a plurality of apertures for the passage of dyed and undyed materials, respectively.

5 Claims, 4 Drawing Sheets

PROCESS AND APPARATUS FOR CONTINUOUS DYEING OF ELONGATE TEXTILE MATERIAL

BACKGROUND OF THE INVENTION

1. Field of the Invention

This invention relates to a process and apparatus for continuous dyeing of elongate textile material. More particularly, the invention is directed to the production of an elongate textile material in the form of yarn, tape and the like which is finished with alternately different colors in a substantially continuous cycle of operation.

2. Prior Art

Colored fabric tapes widely used for slide fasteners are typically produced by for example weaving a monochrome warp yarn with weft yarns having different colors at predetermined intervals such as shown in FIG. 4 of the accompanying drawings, the resulting tape having a stripe pattern with alternately changed color zones.

A typical process known in the art for continuously dyeing yarns or elongate fabric tapes usually comprises a first stage of scouring, washing and drying and a second stage of dye-depositing, thermosol treating, washing, rinsing and drying. Apparatus for this process involves a dye bath equipped with a padding roll and reversibly supported so that an initial dye liquor therein is removed, followed by washing the bath and the roll for replacement with a next different dye liquor. This dye replacement further entails the necessity of washing a nip roll associated with the padding roll and other rolls guiding the material which has been dyed. In some cases, an elongate tape is spliced at predetermined intervals for dyeing with different set of colors.

The conventional dyeing process referred to above would involve certain losses of undyed yarn incurred during the course of dye replacement and roll washing, the undyed yarn portions being removed upon dye finish to permit splicing of adjacent effective portions of the yarn that has been dyed. This loss of yarn is objectionably great, and in addition there would inevitably be surface irregularities on a product fabric woven from such spliced yarns, or else spliced joints of the yarn would become dislodged.

In an attempt to eliminate the above material loss in the dyeing of tapes, it was a common practice to use splicing strips interconnecting adjacent tape portions during dyeing. This however is tedious and time-consuming for the extra work to attach and detach the splices.

SUMMARY OF THE INVENTION

With the foregoing difficulties of the prior art in view, the present invention seeks to provide a novel process of and an apparatus for dyeing an elongate textile material with different colors at predetermined intervals in a substantially continuous, uninterrupted cycle of operation; that is, without discontinuing the feed of the material.

The invention further seeks to provide a novel process and apparatus which is capable of continuously dyeing a variety of textile materials in small lots at increased rate of yield.

A process according to the invention essentially comprises: exchanging one dye bath with another successively at a dye-depositing station; simultaneously exchanging nip rolls and guide rolls alternately mounted on a rotatable support means; orienting the direction of feed of the material M' which has been dyed; and passing both undyed material M and dyed materials M' through their respective drying sections in a single drier assembly.

The above and other objects and features of the invention will be better understood from reading the following detailed description with reference to the accompanying drawings.

DETAILED DESCRIPTION

Figure 3:
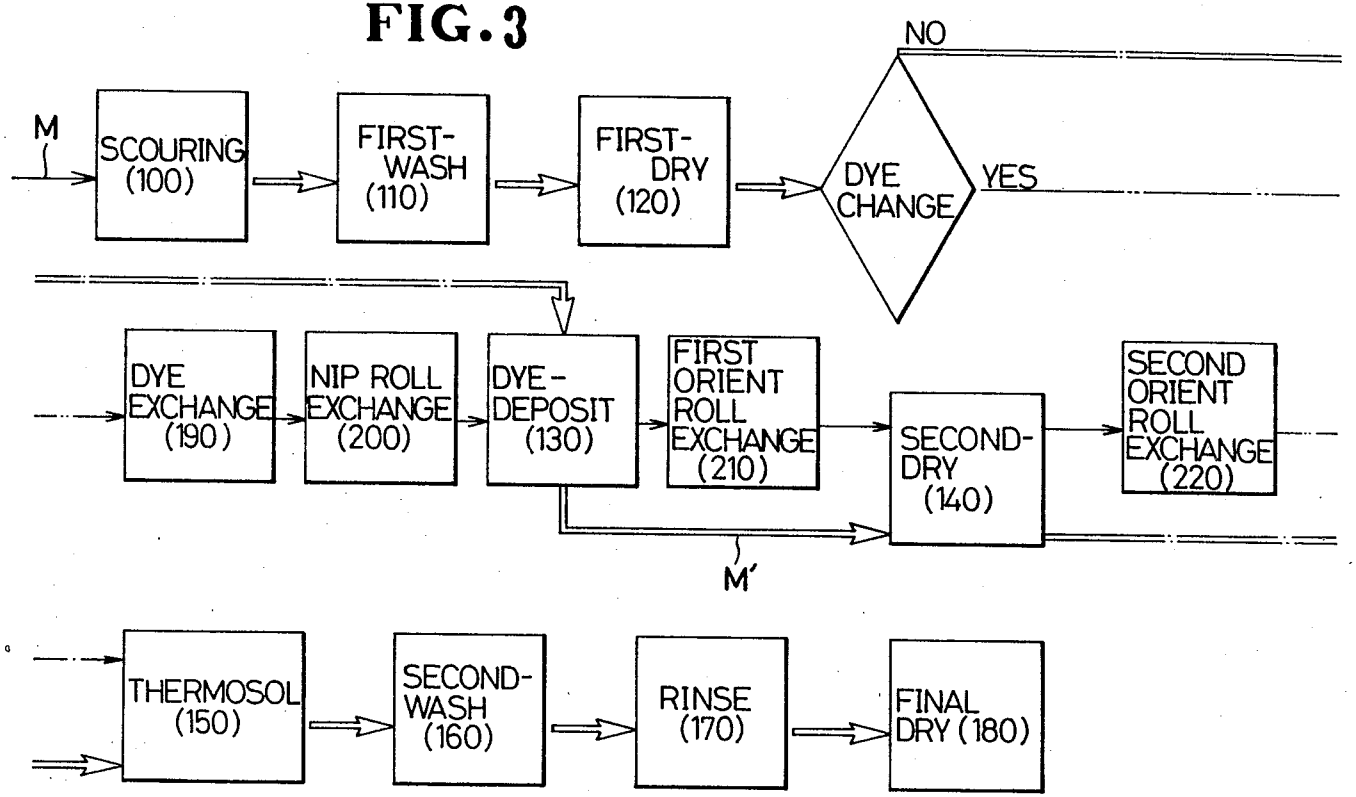
FIG. 3 is a diagrammatic block diagram utilized to explain the process of the invention.
Figure 4:
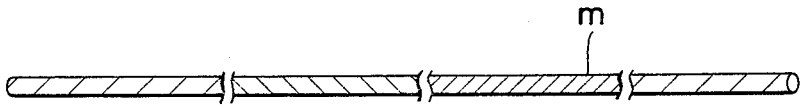
FIG. 4 is a diagrammatic plan view of an elongate textile material dyed in the form of a yarn.
Figure 5:
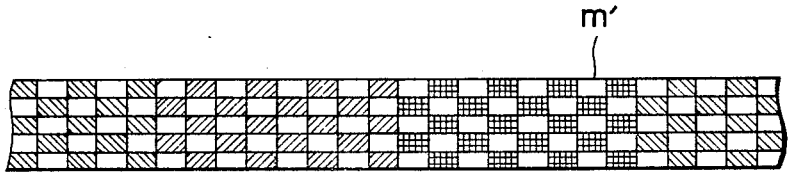
FIG. 5 is a diagrammatic plan view of a tape woven from the yarn of FIG. 4.

Referring now to the drawings and FIG. 3 in particular, there are illustrated the various stages or steps constituting the process of the invention which comprises a first treatment stage including scouring a textile material M as at 100, first-washing the material M as at 110 and first-drying the material M as at 120 and a second treatment stage including dye-depositing the material M as at 130, second-drying the material M as at 140, thermosol-setting the material M as at 150, second-washing the material M as at 160, rinsing the material M as at 170 and final-drying the material M as at 180.

In the case where the textile material M is to be treated with a single color dye, it is transferred from the first-drying station 120 to the dye-depositing station 130, thence directly to the second-drying station 140.

When treating the material M with two or more different coloring dyes as contemplated under the invention, the process also includes the step 190 of exchanging the dye liquors and the step 200 of exchanging the nip rolls and their associated guide rolls, which steps are carried out while the material M is being continuously fed. The process of the invention further includes the step 210 of exchanging the orienting guide rolls in a first assembly during transfer of the plurally dyed material M' from the dye-depositing station 130 to the second-drying station 140 and the step 220 of exchanging the orienting guide rolls in a second assembly during transfer of the material M' from the second-drying station 140 to the thermosol setting station 150.

Figure 1:
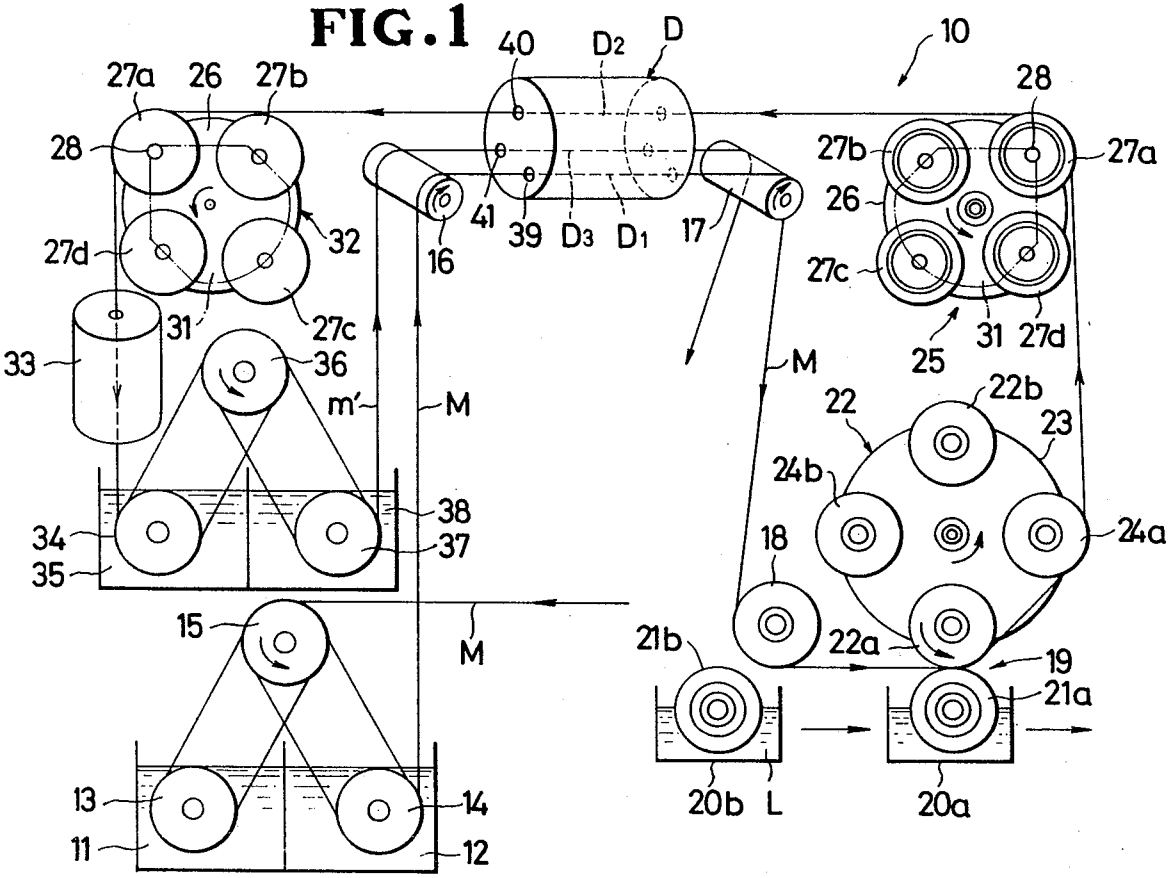
FIG. 1 is a diagrammatic equipment layout utilized to explain the construction and operation of an apparatus embodying the invention.

Reference now to FIG. 1 shows a dyeing apparatus which is used to carry the above process into practice in accordance with the invention. The apparatus generally designated at 10 comprises a scouring bath 11 and a washing bath 12 disposed horizontally parallel therewith.

The baths 11 and 12 have dip rolls 13 and 14 respectively immersed in their respective treatment liquors. A first drive roll 15 is located above and intermediate between the dip rolls 13 and 14 and feeds a starting undyed elongate textile material M which trains around the scouring dip roll 13 and then around the washing dip roll 14. The textile material M moves upwardly from the washing bath 12 as it is fed by and around a second drive roll 16 and enters into a first-drying section $D_1$ in a drier assembly D. The material M advances around a third drive roll 17 located in parallel with the second drive roll 16 across the drier assembly D. As it moves past around a guide roll 18, the material M is oriented to travel in a horizontal path toward a dye-depositing station 19 to which a plurality of dye-depositing baths 20*a*, 20*b* each are successively transported in a horizontal direction. Each of the dye baths 20*a*, 20*b* contains one of a selected set of color dye liquors L and accommodates a padding roll 21*a* (21*b*) which transfers the dye liquor to the textile material M in cooperation with a nip and guide roll assembly 22 including nip rolls 22*a*, 22*b* and guide rolls 24*a*, 24*b* mounted on a support disc member 23. The disc member 23 is provided peripherally with a plurality of nip rolls 22*a*, 22*b* and guide rolls 24*a* and 24*b* alternating in equally spaced position with each other as shown in FIG. 1.

The number of the nip rolls and the guide rolls may vary with the number of the dye baths 20*a*, 20*b* corresponding to the number of dye colors to be applied onto the textile material M.

In the presently illustrated embodiment, there are two vertically, diametrically opposed nip rolls 22*a* and 22*b*, two horizontally diametrically opposed guide rolls 24*a* and 24*b* on the support disc 23 for applying two different dye liquors from the respective dye baths 20*a*, 20*b* which may be conveniently arranged to move toward and away from the operative position in which they alternately come into rotative engagement with the nip roll 22*a* or 22*b*.

Figure 6:
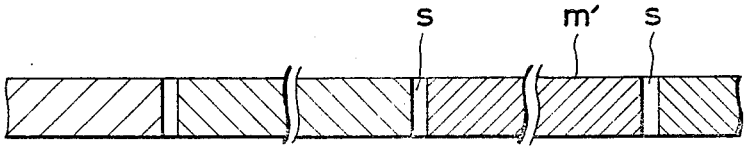
FIG. 6 is a diagrammatic plan view of an elongate textile material dyed in the form of a tape.

The textile material M while in continuous travel is dyed in contact between the padding roll 21*a* and the nip roll 22*a* at the dye-depositing station 19. As the material M is deposited with a dye from the dye bath 20*a* over a predetermined length, the support disc 23 rotates 180° to bring the other nip roll 22*b* into contact with the material M over the next predetermined length against the padding roll 21*b* in the dye bath 20*b* which has been exchanged with the previous dye bath 20*a*, and the material M is thus deposited with another different dye from the bath 20*b*. Exchange of the nip and guide rolls on the support disc 23 is coincidental with that of the dye baths 20*a* and 20*b* and only instantaneous to leave a small dye-free space portion S (FIG. 6) between adjacent leading and ensuing sections of the material M' which has been dyed.

Figure 2:
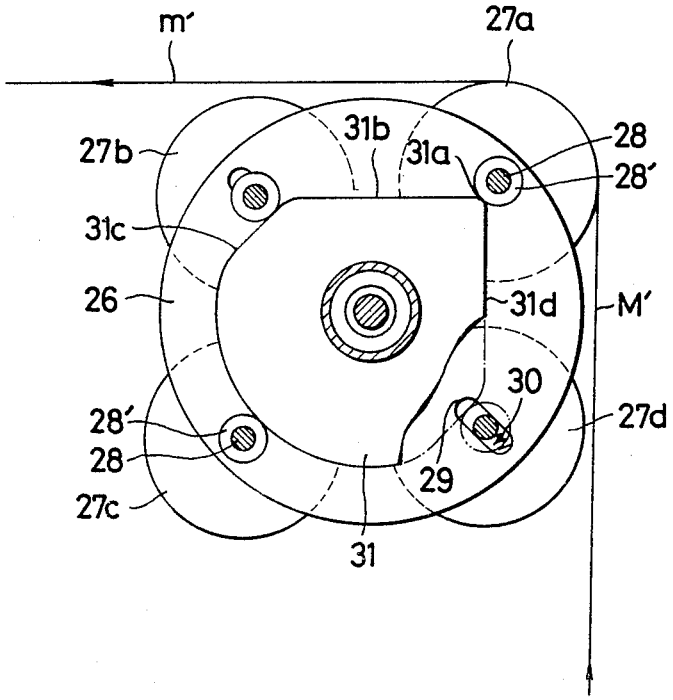
FIG. 2 is a diagrammatic side elevational view on enlarged scale of a guide roll assembly constituting part of the inventive apparatus.

Designated at 25 is a first orienting guide roll assembly located above the nip and guide roll assembly 22 and adapted to orient the direction of travel of the material M' from vertical to horizontal toward the drier assembly D. The orienting guide roll assembly 25, as better shown in FIG. 2, comprises a rotary support disc 26 carrying around its periphery a plurality of equally spaced orienting guide rolls 27*a* -27*d* for alternately engaging and guiding the material M' toward the drier assembly D. Each of the guide rolls 27*a*–27*d* is rotatable about a pin 28 received in an elongated slot 29 and is biased normally radially toward the axis of the disc 26 by the action of a spring 30 accommodated in the slot 29. A polygonal cam plate 31 is fixedly secured to a machine frame and adapted to come peripherally into abutting engagement with the pin 28 via roller 28' thereon to impart a camming action to each of the orienting guide rolls 27*a*–27*d* such that only a selected one of these rolls engages the material M' at the position of orientation thereof, while the rest of the rolls on the disc 26 are retracted from the path of travel of the material M'. To this end, the cam plate 31 has a first cam surface 31*a* engageable with the roller 28' of the guide roll 27*a* to retain the latter in guiding engagement with undyeded portion of the material M', a second cam surface 31*b* extending substantially parallel with the horizontal run of travel of the material M, a third cam surface 31*c* sloped downwardly from the second cam surface 31*b* to retract the roll 27*a* away from the path of the material M' and extending arcuately to engage with the other rolls 27*b*–27*d* while the roll 27*a* is in guiding engagement with the material M' and a fourth cam surface 31*d* extending vertically in parallel with the vertical path of the material M' so that the roll 27*d* following the first or in-service roll 27*a* contacts the material M' while moving upwardly toward the point of orientation of the material M' for exchange with the roll 27*a*.

The dye-free space portion S on the elongate textile material M defined between the trailing end of a leading dyed portion and the leading end of the next following or ensuing dyed portion is detected by means not shown when having approached the position of the first orienting guide roll 27*a* (at which the direction of travel of the material M' is changed from vertical to horizontal), whereupon the support disc 26 begins to rotate counterclockwise as viewed in the drawings, causing the first roll 27*a* to move horizontally toward the drier assembly D along the second cam surface 31*b* until the roll 27*a* reaches and descends along the third cam surface 31*c* to disengage from the material M'. Departure of the first roll 27*a* is substantially coincidental with arrival via fourth cam surface 31*d* of the ensuing roll 27*d* at the position of orientation of the material M'. Thus, exchange of the orienting guide rolls 27*a*–27*d* is effected in succession by intermittent rotary movement of the disc 26 whereby it is made possible to eliminate the risk of transferring the dye on dyed portion to adjacent dyed portions of the elongate material M' which would otherwise occur to stain or discolor the material M'.

Dyed material M' upon orientation as the orienting guide roll assembly 25 moves on horizontally and enters the drier assembly D through a second-drying section $D_2$, and it thence arrives at a second orienting guide roll assembly 32 which is identical in construction and function with the first assembly 25 already described. At the second assembly 32 the material M is oriented in its direction of travel from horizontal to vertical, and it then enters a thermosol setting drum 33. The material M' is thereafter trained around a dip roll 34 in a rinsing bath 35 and past a drive roll 36 and around a dip roll 37 in a finish washing bath 38 adjoining the bath 35. The material M' thus cleaned is taken upwardly past the second drive roll 16 into the drier assembly D through a third-drying section D3 and withdrawn via the third drive roll 17 for delivery as finished textile material.

The drier assembly D is a single integral cylindrical drum construction capable of drying the textile material M and M' on passing through three respective guide apertures 39, 40 and 41 in the drum. The size of the aperture 40 in particular can be reduced to a minimum required for the particular yarn or tape to be treated, because of the arrangement of the orienting guide roll assembly 25 and 32 in which the guide rolls 27*a*–27*d* are retractable from the path of travel of the material M' without causing the latter to deflect or jiggle which would otherwise occur to make the material M' to hit the edges of the aperture 40, resulting in color transfer or damage of the material M'.

The material M treated in the process and apparatus of the invention above described is a fibrous polyester material in the form of a yarn or tape. When treating other materials such as rayon, nylon, acryl and the like fibers, the thermosol setting treatment may be substituted by steaming and there may be additionally provided surface coating on such dyed materials.

Obviously, various modifications and variations of the present invention are possible in the light of the above teaching. It is therefore to be understood that within the scope of the appended claims the invention may be practiced otherwise than as specifically described.

What is claimed is:

1. A process of dyeing an elongate textile material with different colors at predetermined intervals in a substantially continuous, uninterrupted cycle of operation which comprises scouring, washing, drying, dye-depositing, thermosol setting, final washing, rinsing and drying and which further comprises the steps of:

(a) exchanging one dye bath with another successively at a dye-depositing station;

(b) simultaneously exchanging nip rolls and guide rolls alternately mounted on a rotatable support means;

(c) orienting the direction of feed of the material which has been dyed; and (d) passing both undyed material and dyed material through their respective drying sections in a single drier assembly.

2. An apparatus for carrying the process of claim 1 into practice which comprises:

(a) a plurality of dye baths movable for exchange toward and away from the position of dye-depositing the material;

(b) a nip and guide roll assembly including a support means carrying a plurality of equally spaced nip rolls and guide rolls, said means being rotatable to exchange said rolls corresponding to the exchange of said dye baths;

(c) a first orienting guide roll assembly including a support means carrying around its periphery a plurality of equally spaced orienting rolls, said means being intermittenly rotatable to take one of said rolls into and out of engagement with the material to orient the direction of feed of the material;

(d) a drier assembly in the form of a single cylindrical drum having apertures for the passage of undyed and dyed materials respectively; and (e) a second orienting guide roll assembly which is similar in construction and function to said first assembly and located in opposition to said assembly across said drier assembly for re-orienting the direction of feed of the material.

3. An apparatus according to claim 2 in which said orienting guide rolls each are biased normally radially toward the axis of said means.

4. An apparatus according to claims 2 and 3 further including a polygonal cam plate fixedly secured to a machine frame and adapted to retract one of said orienting guide rolls away from the path of the material while exchanging said rolls in their respective positions.

5. An apparatus according to claim 4 in which said cam plate has a cam surface extending substantially parallel with the path of the material and another cam surface downwardly sloped to retract one of said rolls away from the path of the material.

* * * * *